US007541604B2

(12) United States Patent
Goetze et al.

(10) Patent No.: US 7,541,604 B2
(45) Date of Patent: Jun. 2, 2009

(54) ARRANGEMENT FOR THE GENERATION OF SHORT-WAVELENGTH RADIATION BASED ON A GAS DISCHARGE PLASMA AND METHOD FOR THE PRODUCTION OF COOLANT-CARRYING ELECTRODE HOUSINGS

(75) Inventors: Sven Goetze, Goettingen (DE); Harald Ebel, Goettingen (DE); Juergen Kleinschmidt, Goettingen (DE); Imtiaz Ahmad, Goettingen (DE)

(73) Assignee: XTREME techonolgies GmbH, Jena (DE)

( * ) Notice: Subject to any disclaimer, the term of this patent is extended or adjusted under 35 U.S.C. 154(b) by 419 days.

(21) Appl. No.: 11/560,118

(22) Filed: Nov. 15, 2006

(65) Prior Publication Data

US 2007/0114946 A1 May 24, 2007

(30) Foreign Application Priority Data

Nov. 18, 2005 (DE) ..... 10 2005 055 686

(51) Int. Cl.
*H01J 17/26* (2006.01)
*H01J 35/00* (2006.01)

(52) U.S. Cl. ..... 250/504 R; 250/365; 315/111.21; 315/111.71; 313/231.31; 313/231.61; 313/231.71

(58) Field of Classification Search ..... 313/231.31, 313/231.41, 231.61, 231.71; 315/111.21, 315/111.71, 111.01; 250/365, 504 R; 378/119
See application file for complete search history.

(56) References Cited

U.S. PATENT DOCUMENTS 6,414,438 B1 * 7/2002 Borisov et al. ..... 315/111.31
6,815,900 B2 * 11/2004 Ahmad et al. ..... 315/111.21
6,894,298 B2 * 5/2005 Ahmad et al. ..... 250/504 R
2003/0068012 A1 * 4/2003 Ahmad et al. ..... 378/119
2004/0071267 A1 4/2004 Jacob et al.
2004/0160155 A1 8/2004 Partlo et al.
2007/0114946 A1 * 5/2007 Goetze et al. ..... 315/111.21

FOREIGN PATENT DOCUMENTS

DE 102 60 458 7/2004

* cited by examiner

*Primary Examiner*—Bernard E Souw
(74) *Attorney, Agent, or Firm*—Reed Smith LLP

(57) ABSTRACT

The invention is directed to an arrangement for the generation of short-wavelength radiation based on a hot plasma generated by gas discharge and to a method for the production of coolant-carrying electrode housings. It is the object of the invention to find a novel possibility for gas discharge based short-wavelength radiation sources with high average radiation output in quasi-continuous discharge operation by which efficient cooling principles can be implemented using inexpensive and simple means in order to prevent a temporary melting of the electrode surfaces and, therefore, to ensure a long lifetime of the electrodes. According to the invention, this object is met in that special cooling channels for circulating coolant are integrated in electrode collars of the electrode housings. The cooling channels are advanced radially up to within a few millimeters of the highly thermally stressed surface regions and are connected by necked-down channel portions which are arranged coaxial to the axis of symmetry and which are provided with channel structures for increasing the inner surface and for increasing the flow rate of the coolant.

39 Claims, 7 Drawing Sheets

ARRANGEMENT FOR THE GENERATION OF SHORT-WAVELENGTH RADIATION BASED ON A GAS DISCHARGE PLASMA AND METHOD FOR THE PRODUCTION OF COOLANT-CARRYING ELECTRODE HOUSINGS

CROSS-REFERENCE TO RELATED APPLICATION

This application claims priority of German Application No. 10 2005 055 686.8, filed Nov. 18, 2005, the complete disclosure of which is hereby incorporated by reference.

BACKGROUND OF THE INVENTION a) Field of the Invention

The invention is directed to an arrangement for the generation of short-wavelength radiation based on a hot plasma generated by gas discharge and to a method for the production of coolant-carrying electrode housings for the gas discharge, in particular for a radiation source for the generation of extreme ultraviolet (EUV) radiation in the wavelength range of 11 nm to 14 nm.

b) Description of the Related Art

As structures of integrated circuits on chips become increasingly smaller in the future, radiation of increasingly shorter wavelength will be needed in the semiconductor industry for exposure of these structures. Lithography machines with excimer lasers whose shortest wavelength is reached at 157 nm and in which transmission optics or catadioptric systems are employed are currently in use. Based on Moorer's law, new radiation sources with even shorter wavelengths must be made available in the future in order to increase imaging resolution in the lithographic process for semiconductor chip fabrication.

Since there are no available transmission optics for these new radiation sources with wavelengths below 157 nm, reflection optics must be used. However, as is well known, these reflection optics have a very limited numerical aperture. This results in a decreased resolution of the optical systems which can only be compensated by a further reduction in wavelength.

There are several known techniques suitable for the generation of EUV radiation (in the wavelength range from 11 nm to 14 nm), of which the generation of radiation from laser-induced plasma and from gas discharge plasmas shows the greatest potential. There are, in turn, several concepts for gas discharge plasmas, e.g., plasma focus, capillary discharge, hollow cathode discharge, and Z pinch discharge. In the latter technique, an especially great effort has been directed toward cooling the electrodes. However, the solutions developed for this can also be applied to the other gas discharge techniques.

The prior art solutions for electrode cooling are basically tied to a cooling circuit in which, for the most part, cooling channels with rib structures are used in the electrode bodies.

U.S. Pat. No. 6,815,900 B2, for example, discloses a radiation source for the generation of EUV radiation based on a gas discharge plasma and describes optimized concentric electrode housings for achieving a high average radiation output and long-term stability. The gas discharge takes place between a collar-shaped anode and cathode in the interior of the electrode housing. Cavities with ribs, porous material or capillary structures (so-called heat pipe arrangements) through which a coolant flows are provided in the walls of the electrode housings.

US 2004/0071267 A1 discloses a plasma focus radiation source for the generation of EUV radiation which uses lithium vapor and which likewise has a coaxial anode-cathode configuration. In order to reduce erosion and increase the lifetime of the electrodes, a heat pipe cooling arrangement is provided in addition to the combined thermal radiation cooling and thermal conduction cooling so that the electrode tips are kept below the melting temperature even though these electrode tips comprise high-melting tungsten. The principle of liquid evaporation is used in the heated area of the heat pipe and that of condensation in a cold area of the heat pipe. The liquid is returned via a wick. Because of the high latent evaporation heat from the vaporization and condensation of lithium (vaporization heat of 21 kJ/g), it is possible to transfer a heat load of about 5 kW without high mass flow rates.

Further, US 2004/0160155 A1 discloses a gas discharge EUV source which suppresses debris exiting from the plasma by means of a metal halogen gas generating a metal halide with the debris exiting the plasma. The source has a special anode comprising differentially doped ceramic material (e.g., silicon carbide or alumina) containing boron nitride or a metal oxide (such as SiO or $TiO_2$) as dopant so as to be electrically conductive in a first region and thermally conductive in a second region, the first region being associated with the electrode surface. This electrode is then cooled through a hollow interior having two coolant channels or porous metal which defines coolant passages.

All of the above-described solutions for electrode cooling have the disadvantage of a comparatively high cost of production, particularly when cooling is effected by bundles of capillary structures or by porous material which exceeds the cost and compactness of simple cooling mechanisms (e.g., cooling channels provided with ribs) many times over. Other disadvantages include the impossibility of a monolithic construction, the complexity, and the relatively large space requirement for integrating the special structures for increasing the surface in the electrodes.

Since the complexity, the dimensions and, above all, the cost of a radiation source of this type according to the gas discharge concept described above determine the ultimate success or failure of the radiation sources when used in semiconductor lithography, an attempt must be made to develop the individual components (e.g., the electrodes with cooling arrangements) at a lower technological and financial cost with the same or higher efficiency (particularly with respect to lifetime) compared to current highly developed technology.

OBJECT AND SUMMARY OF THE INVENTION

It is the primary object of the invention to find a novel possibility for gas discharge based short-wavelength radiation sources with high average radiation output in quasi-continuous discharge operation by which efficient cooling principles can be implemented in an inexpensive and simple manner in order to prevent a temporary melting of the electrode surfaces and, therefore, to ensure a long lifetime of the electrodes without requiring substantially larger electrode housings and larger amounts of coolant.

This object is met in an arrangement for the generation of short-wavelength radiation based on a hot plasma generated through gas discharge which contains a discharge chamber which is enclosed by and evacuated in a first and a second coaxial electrode housing and in which a work gas is introduced under a defined pressure and which has an outlet opening for the short-wavelength radiation. The two electrode housings are electrically insulated from one another so as to resist dielectric breakdown by an insulator layer, and the second electrode housing projects by a necked-down outlet into the first electrode housing to enable a gas discharge with a region around the outlet opening of the first electrode housing. In this arrangement, the above-stated object is met according to the invention in that the first electrode housing around the outlet opening and the second electrode housing at the necked-down outlet each have an electrode collar so that the gas discharge for generating the radiating plasma is deliberately ignited between these electrode collars inside the discharge chamber of the first electrode housing, special cooling channels for circulating coolant being integrated in the electrode material in the electrode collars, in that the cooling channels are advanced radially up to within a few millimeters of the highly thermally stressed surface regions of the electrode collars and have a necked-down channel portion in the area of the highly stressed surface substantially parallel to the axis of symmetry of the electrode housing in order to increase the flow rate of a circulating coolant, and in that the necked-down channel portion is provided with channel structures for increasing the inner surface and for further increasing the flow rate of the circulating coolant, and the channel structures are generated by suitable surface-working of the necked-down channel portions.

The necked-down channel portions are advantageously provided with a channel structure by subsequent removal of material. The removal of material is advantageously carried out by abrasive blasting with large-particle material, particularly one of the following blast materials: chilled cast granules, glass beads, steel shot, or corundum. The necked-down channel portion can also be structured by etching or material pulverization.

In a further advantageous construction, the necked-down channel portion is provided with a channel structure by subsequent coating. The necked-down channel portion is advisably structured by applying granular material comprising at least one metal, metal alloy or metal ceramic with very good thermal conductivity. It has proven advantageous that the granular material contains at least one of the following metals: copper, aluminum, silver, gold, molybdenum, tungsten or an alloy thereof. It preferably comprises one of the alloys MoCu, WCu or AgCu or one of the metal ceramics AlO, SiC or AlN. Further, the granular material can advantageously comprise diamond.

The diameter of a necked-down channel portion is advisably adapted to the particle size of the granules that are used. The diameter of the channel portion is at least twice as large as the particle size of the granules. The diameter of the necked-down channel portion is advantageously between 100 μm and 2 mm.

In an advantageous construction of the cooling structure of the electrode housing, the necked-down channel portion is constructed as a concentric annular gap around the axis of symmetry of the electrode housing.

In another advisable construction, necked-down channel portions are generated by bore holes. This variant has the advantage that a channel structure can be formed by cutting an internal thread.

Preferably, a low-viscosity coolant flows through the necked-down channel portions. Deionized water or a special oil, particularly galden, is advisably used for this purpose.

Further, in a method for producing coolant-carrying electrode housings for hot plasma generated by gas discharge, wherein a discharge chamber is enclosed by and evacuated in a first and a second coaxial electrode housing and a work gas is introduced into the latter under a defined pressure, wherein the two electrode housings are electrically insulated from one another so as to resist dielectric breakdown by an insulator layer and have cooling channels, and the second electrode housing projects by a necked-down outlet into the first electrode housing to enable a gas discharge with an oppositely located region of the first electrode housing, the above-stated object is met in that the cooling channels are drilled into the electrode housings in at least two different orthogonal planes relative to an axis of symmetry of the electrode housings radially inward proceeding from the outside to a distance of up to a few millimeters from the highly thermally stressed surfaces, and in that a necked-down channel portion is carried out substantially parallel to the axis of symmetry in such a way that it produces a connection channel of small diameter respectively between two cooling channels of different orthogonal planes in an end region of the radially drilled cooling channels.

The necked-down channel portion is advantageously recessed concentric to the axis of symmetry as a narrow annular gap so that it surrounds the electrode collar contiguously and completely in the electrode housing. Two cooling channels are arranged opposite one another with respect to the axis of symmetry in the different orthogonal planes as an inlet and outlet for the circulating coolant.

In another advisable construction, necked-down channel portions are drilled into the electrode material coaxial to the axis of symmetry as bore holes, and multiple channel portions of this kind which are drilled in a uniformly distributed manner can be arranged so as to surround the electrode collars inside the electrode housing along a cylindrical outer surface concentric to the axis of symmetry (6).

The necked-down channel portions are advisably provided with a channel structure by material removal in order to increase the inner surface. The channel structure is preferably generated by cutting a thread, by etching or by material pulverization.

In a second basic variant, the necked-down channel portions are provided with a channel structure by material application (coating). In this case, the channel structure is advisably generated by granules of metal, metal alloy or metal ceramic with good thermal conductivity and is applied by spraying techniques to the inner walls of the necked-down channel portions. The granules are fixed to the inner surfaces of the channel portion by melting the granules, by simple bombardment of the surface with the appropriate granules at very high pressure, or, particularly with metal ceramics, although not limited to this, by a solder connection.

Openings which are formed at the electrode housings when producing the necked-down channel portions but which are not required for the circulation of coolant are advisably hermetically sealed by closing plugs of electrode material. This can be carried out by melting the closing plug in the opening or by screwing in and melting a threaded pin or a screw.

Further, openings which are formed at the electrode housings when producing the necked-down channel portions but which are not required for coolant circulation are hermetically sealed by covering them with at least one part which is or becomes an integral part of the electrode housing. The covering part of the electrode housing can be produced by cutting the electrode housing along a suitable cutting plane, in which case the cutting is carried out before introducing channel portions, or it can be produced by suitable shaping of matching separate parts of the main part and the covering part of the electrode housing, in which case the separate parts of the electrode housing are joined after introducing necked-down channel portions in the main part along an imaginary cutting plane.

The invention is based on the consideration that substantially greater amounts of energy can be supplied continuously to the discharge unit without increased erosion at the electrodes due to melting of the electrode surfaces by means of an optimized electrode geometry combined with a suitable selection of material and a more efficient heat transfer. In this connection, it was necessary to solve the problem of creating more efficient cooling structures at a reasonable technical and financial cost. Consequently, the essence of the invention consists in advancing the cooling channels for the cooling medium as close as possible to the highly stressed electrode surfaces and, in addition, in the introduction of cooling channels produced by simple processing steps into suitably shaped electrode housings so that the coolant flows past at a high speed close to the highly stressed electrode regions in necked-down channel portions with the largest possible inner surface.

The invention makes it possible to increase the lifetime of the electrodes for gas discharge based short-wavelength radiation sources with high average radiation output in quasi-continuous discharge operation by implementing efficient cooling principles which prevent a temporary melting of the electrode surfaces in an inexpensive manner and by simple production techniques.

The invention will be described more fully in the following with reference to embodiment examples.

DESCRIPTION OF THE PREFERRED EMBODIMENTS

Figure 1:
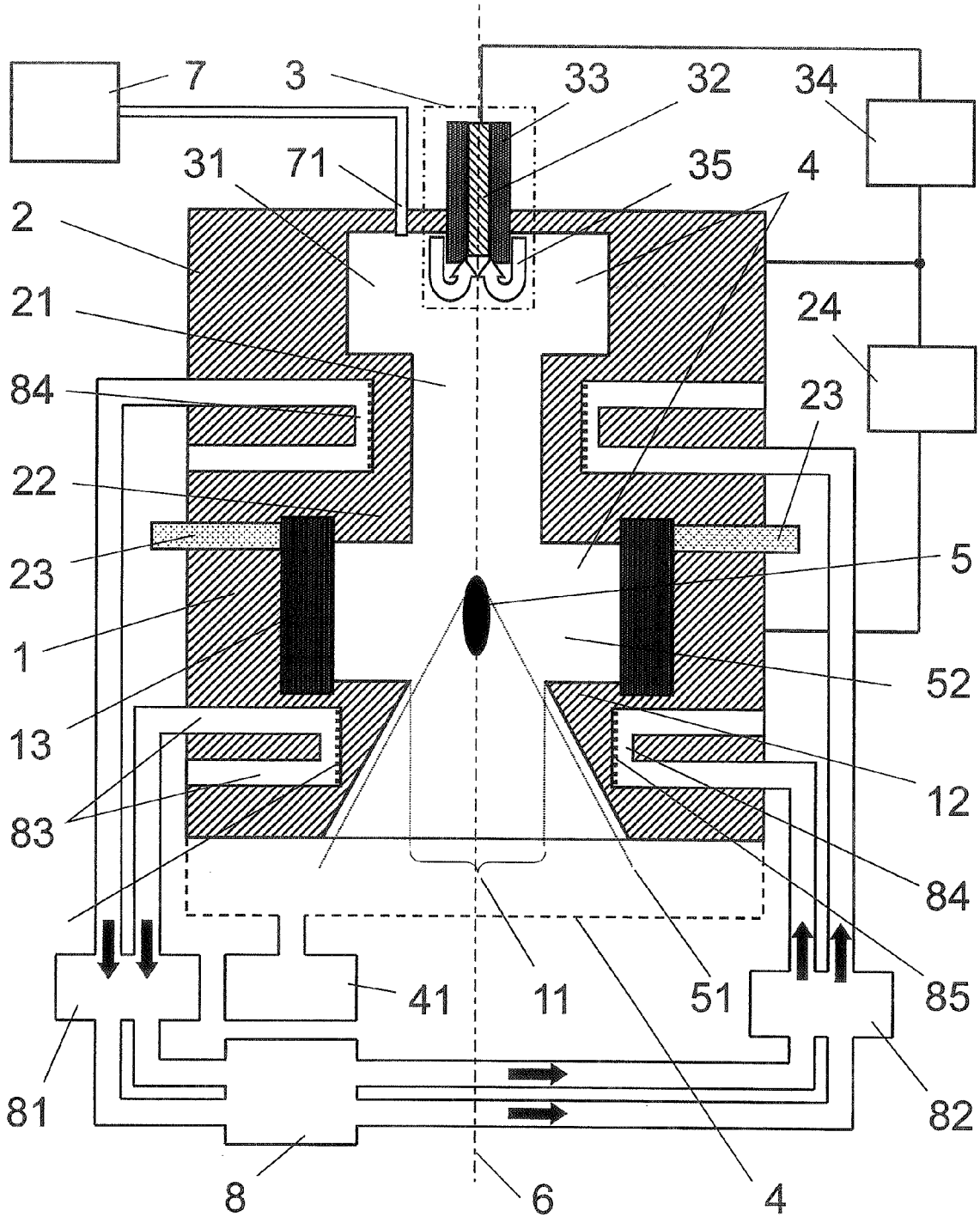
FIG. 1 shows a basic view of the radiation source according to the invention with electrode cooling in which additional cooling channels with necked-down cross section and with an enlarged surface that is simultaneously structured by suitable surface treatment are provided in the area of the highly stressed electrode surfaces (electrode collars)

As is shown in FIG. 1, the basic construction of the radiation source according to the invention includes a first electrode housing 1 and a second electrode housing 2 which are insulated from one another with respect to high voltage by means of an insulating layer 23 comprising electrically highly insulating materials, gases or a high vacuum, a preionization unit 3 which is arranged coaxially inside the second electrode housing 2, and a gas supply unit 7 for the strictly regulated supply of work gas to the first and second electrode housings 1 and 2 which form part of a vacuum unit 4 in which a vacuum pressure is realized by means of a vacuum pump device 41.

The two electrode housings 1 and 2 are arranged coaxial to one another and each has an electrode collar 12 and 22, respectively, at its end face. The electrode collar 22 of the second electrode housing 2 projects into the first electrode housing 1 so as to be supported by a tubular insulator 13 in the interior of the first electrode housing 1 and prescribes defined discharge paths to the electrode collar 12 of the first electrode housing 1 in the discharge chamber 52 formed by the second electrode housing 2.

The preionization unit 3 contains an insulator tube 33 of highly-insulating ceramic through which a preionization electrode 32 which is formed axially symmetric to the axis of symmetry 6 is guided into the interior of the second electrode housing 2. A surface sliding discharge 35 is generated from the end of the preionization electrode 32 in the preionization chamber 31 via the insulator tube 33 to the counter-electrode which is advisably formed by the rear end face of the second electrode housing 2. A defined vacuum pressure is generated in the preionization chamber 31 and in the discharge chamber 52, which make up part of a vacuum unit 4, by means of a connected vacuum pump device 41. Work gas for the gas discharge is introduced via at least one gas inlet 71 from a regulated gas supply unit 7.

After being supplied at a determined gas pressure, the work gas is preionized by means of the above-mentioned sliding surface discharge 35 inside the preionization chamber 31 by the preionization unit 3 to which voltage is applied opposite from the electrode housing 2 by the preionization pulse generator 34. The preionized work gas passes through a necked-down outlet 21 of the second electrode housing 2 into the discharge chamber 52 formed by the first electrode housing 1. In this discharge chamber 52, a gas discharge current flows between the electrode collar 22 of the second electrode housing 2 and the electrode collar 12 of the first electrode housing 1 in that a high voltage is applied to the two electrode housings 1 and 2 by the high-voltage pulse generator 24. Because of its induced magnetic field, the gas discharge current generates a hot plasma 5 plasma column) which is condensed in the axis of symmetry 6.

Without limiting generality, the first electrode housing 1 is connected as a cathode and the second electrode housing 2 is connected as an anode to generate the gas discharge, and the high-voltage pulse generator 24 is designed in such a way that its voltage and its supplied energy are sufficient to ignite gas discharges between the anode and the cathode (pulsed at a frequency between 1 Hz and 10 kHz), these gas discharges generating a plasma 5 of high temperature and density such that a sufficiently large proportion of extreme ultraviolet (EUV) radiation 51 is emitted through the outlet opening 11 of the first electrode housing 1.

Because of the considerable heat radiation from the generated hot plasma 5 and the heating of the electrode collars 12 and 22 caused by the high gas discharge currents, a very intensive cooling of the electrode system is necessary. Although this is not illustrated in the drawings for the sake of simplicity, a simple (external) cooling of the electrode housings 1 and 2, such as is described, for example, in U.S. Pat. No. 6,815,900 B2, can be operated in a conventional manner in that it is likewise connected to a heat exchanger system 8, shown in FIG. 1, with coolant reservoir 81 and coolant pump unit 82.

A special cooling system according to the invention has separate cooling channels 83, specifically for each electrode housing 1 and 2, which are guided up to the highly thermally stressed surface regions of the electrode housings 1 and 2, respectively, namely the electrode collars 12 and 22. In the vicinity of the surface regions of the electrode collars 12 and 22, the cooling channels 83 have necked-down channel portions 84 (with reduced diameter) and a channel structure 85 for relative surface enlargement (by internal structuring) in order to increase the flow rate of the coolant on one hand and to increase the available surface for heat transfer on the other hand.

The channel portions 84 are produced with cross sections which are sufficiently small so that the coolant increases its flow rate in the channel portions 84, with the coolant throughput (coolant volume per time unit) remaining the same, so that the heat given off by the highly stressed electrode collars 12 and 22 is removed faster by the circulating coolant.

In order to increase the flow rate through the channel portions 84, small efficient channel cross sections (i.e., after the structuring of the channel portion 84) from about 1 millimeter to about 100 micrometers are preferable when a sufficiently high coolant pressure is available. In this case, due to the total volume of a plurality of cooling channels 83 and channel portions 84, a coolant flow of about 10 liters/minute can be adjusted and—comparable to the most efficient cooling principles of the prior art—some kW/cm$^2$ to almost 10 kW/cm$^2$ cooling capacity can be achieved in spite of the small cross section.

Figure 2:
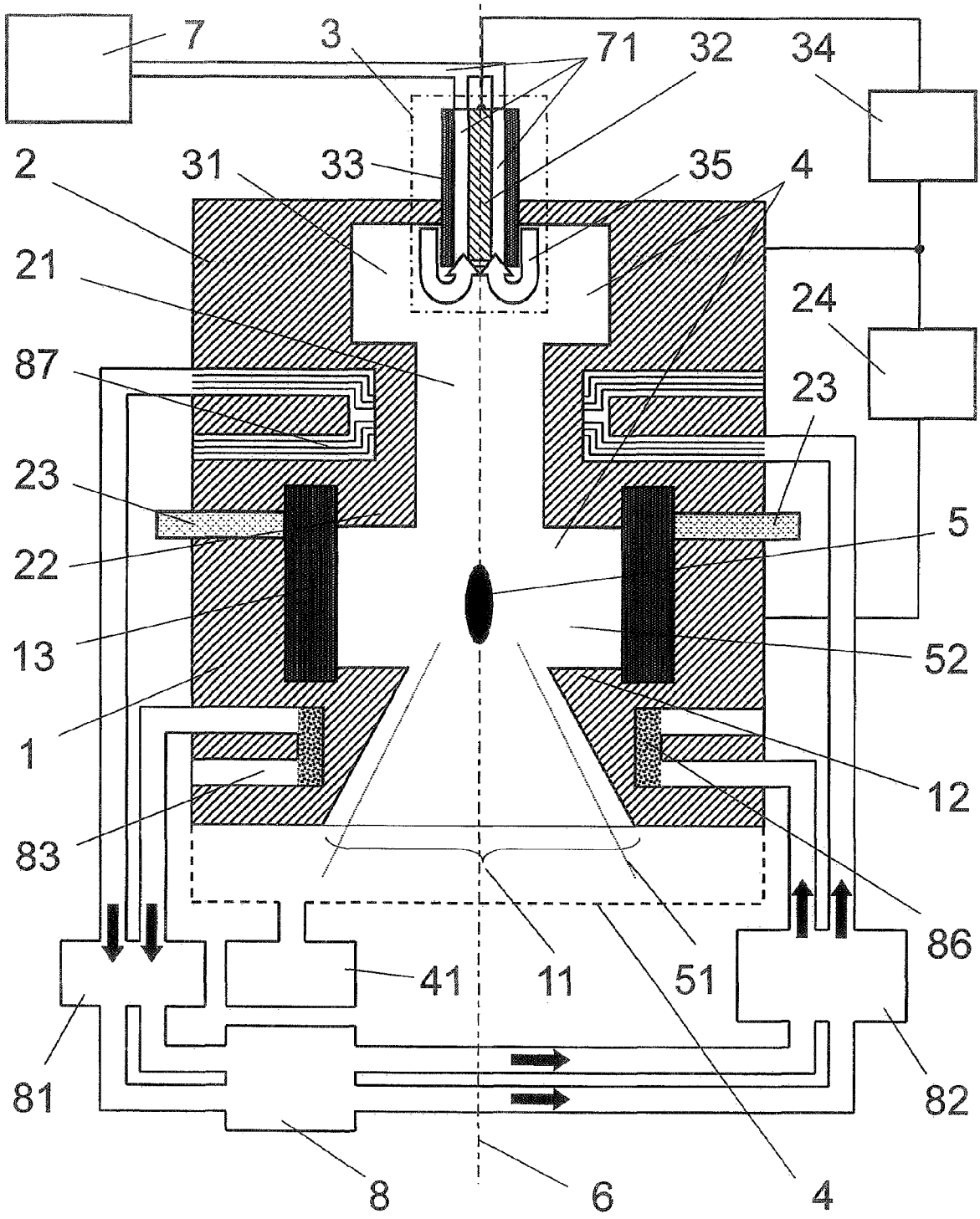
FIG. 2 shows by way of comparison a view of the radiation source with two efficient but expensive cooling mechanisms according to the prior art, electrode cooling by means of circulation through porous material and a capillary structure.

To clarify the difference between the invention and the most efficient cooling structures known from the prior art, FIG. 2 shows—in a schematically integrated illustration—two different known cooling principles according to the prior art in a radiation source designed according to the invention (analogous to FIG. 1) in the two electrode housings 1 and 2, one with porous material 86 and one with a capillary structure 87.

The first electrode housing 1 is outfitted with cavities with porous material 86 for the coolant circulation which serves to increase the surface of the cooling channels 83 and accordingly makes it possible to increase the removal of heat through the circulating coolant. The second electrode housing 2 shows a capillary structure 87 for improving heat removal. A liquid (or a solid which liquefies in a certain state) is provided in the interior of the second electrode housing 2 and can penetrate into the narrow channels of the capillary structure 87 through which heat received from the electrode housing 2 is evaporated, moves within a closed vessel to an outer, cooler part where it can condense, and returns to the hotter region again through capillary forces, whereupon the cycle is repeated.

While heat can be removed from the periphery of the electrode housings 1 and 2 with power densities of 10 kW/cm$^2$ by using porous material 86, as is the case in the electrode housing 1 in FIG. 1, the use of capillary structures 87 is even more efficient and makes it possible to remove heat with power densities beyond 10 kW/cm$^2$.

While it is possible in principle to integrate elaborate cooling structures 86 and 87 of this kind in the highly stressed electrode regions, this cannot be realized at reasonable costs because the highly stressed electrode regions must be additionally adapted with respect to their characteristics (increased melting point and improved thermal and/or electric conductivity) by means of special material melts of tungsten, tantalum or molybdenum, preferably alloyed with copper, and prevent a monolithic construction of the electrode collars 12 and 22 with the cooling structures 86 and 87 which are complicated to manufacture.

Therefore, for an efficient and economical cooling of the electrode regions that are especially stressed, namely the electrode collars 12 and 22, cooling channels 83 are located (according to the basic variant of the invention shown in FIG. 1) in the first and second electrode housings 1 and 2, respectively. These cooling channels 83 have channel portions 84 of reduced diameter and additional channel structure 85 in the region near the surface (minimum distance from the surface is about 10 mm with an anticipated lifetime of about $10^8$ pulses).

The cooling channels 83 are connected via coolant hoses or coolant lines to a coolant reservoir 81 and a suitable coolant pump unit 82 which are connected respectively to an efficient heat exchanger system 8. Liquids having a low viscosity, a high electric thermal capacity and a low electric conductivity (such as special oils, e.g., Galden, demineralized or deionized water, etc.) are used as coolants. The cooling channels 83 can generally have up to a few millimeters in diameter, but should narrow at the points having the above-mentioned channel portions 84 which improve cooling, since these channel portions 84 are closest to the hot surface. When the coolant pressure is sufficiently high, efficient cross sections of the necked-down channel portions 84 are preferably between 0.1 mm and 1 mm in order to further increase flow rate.

In case granular material is applied subsequently, the rough diameter of the channel portions 84 could be up to 2 mm.

The selected distance of the necked-down channel portions 84 from the hot electrode surface should be as small as possible but is preferably 5 mm or more because there must be sufficient erosion material available for a long lifetime of the electrodes. The average temperature at the surface of the electrode collars 12 and 22 depends substantially on the discharge frequency (input power). Accordingly, the melting temperature of tungsten (3650 K), for example, is almost reached at a discharge frequency of about 4 kHz. Since the temperature reached at the electrode collar 12 or 22 is directly proportional to the distance of the channel portion 84 from the electrode surface, the temperature would be approximately halved when the distance is reduced from 5 mm to 2.5 mm. In this case, however, as was already mentioned, there would not be enough material for the inevitable electrode erosion at the surface of the electrode collar 12 or 22 to actually achieve the intended increase in the lifetime of the electrodes.

As it flows through the cooling channels 83, particularly in the channel portion 84 with reduced diameter and with the channel structure 85, the coolant absorbs the excess heat occurring at the electrode collars 12 and 22 through the operation of the radiation source and gives off this heat to the heat exchanger system 8 through convection and heat conduction via the coolant reservoir 81 and is then conveyed again to the cooling channels 83 by the coolant pump unit 82.

Figure 3:
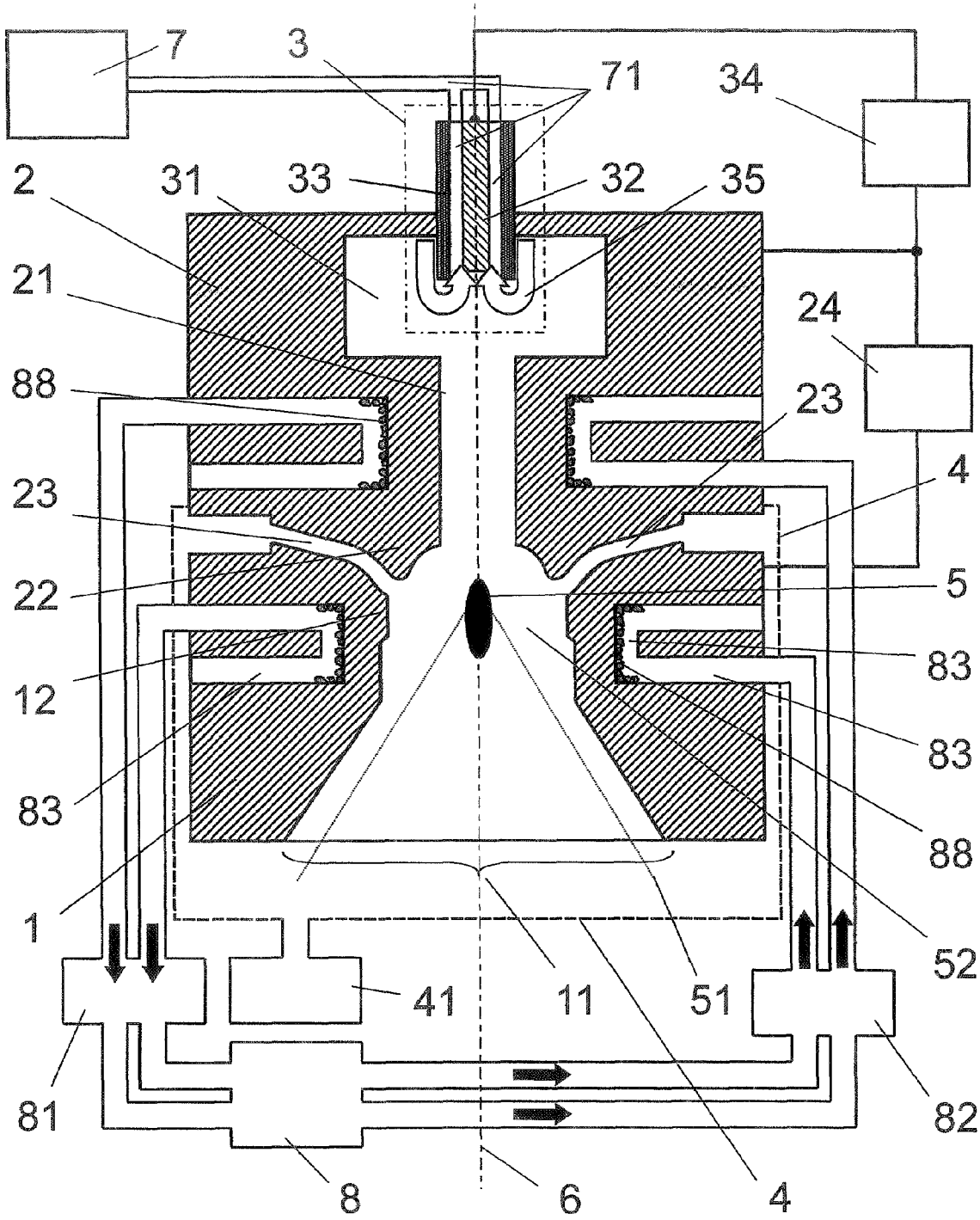
FIG. 3 shows a constructional variant of the invention with cooling channels which have an enlarged surface in highly stressed areas of the electrodes by introducing granular material, and the electrode housings are outfitted with a vacuum insulation.

The channel portions 84 with reduced cross section and channel structure 85 which are shown schematically in FIG. 1 are generated in the interior of the electrode housings 1 and 2 by introducing bore holes with a small diameter and subsequently providing the latter with the channel structure 85. As is shown in FIG. 3, this is preferably carried out by coating with granular material 88 comprising a metal or a metal ceramic with excellent heat conducting properties, e.g., copper, aluminum, silver, gold, tungsten or molybdenum or alloys thereof, e.g., MoCu, WCu, AgCu, or the like, or ceramics such as AlO, SiC, AlN, etc., or diamond.

Figure 5A:
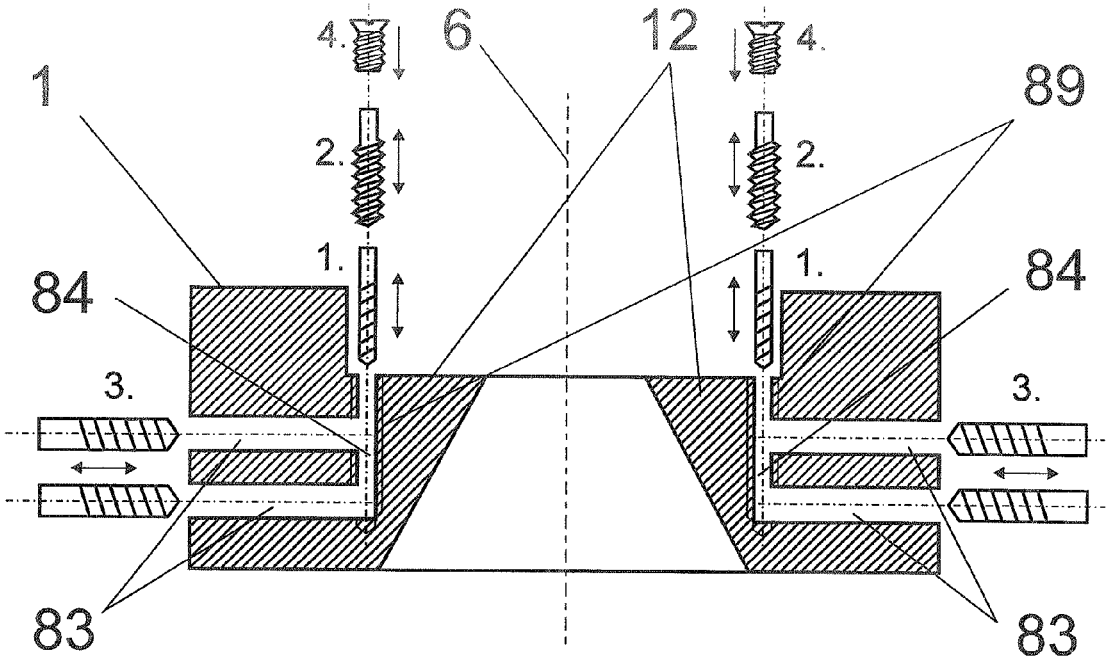
FIG. 5 shows an axial section through an electrode housing with a schematic view of a production method for introducing a) necked-down channel portions with a threaded bore hole and b) bore holes with a granule coating.
Figure 5B:
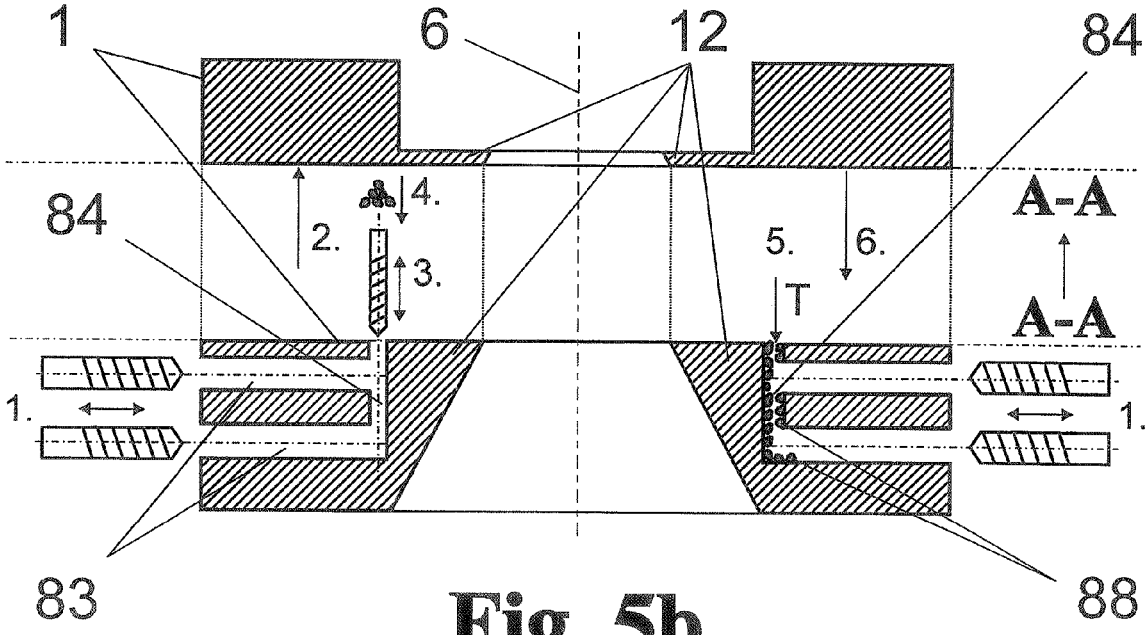
Figure 6A:
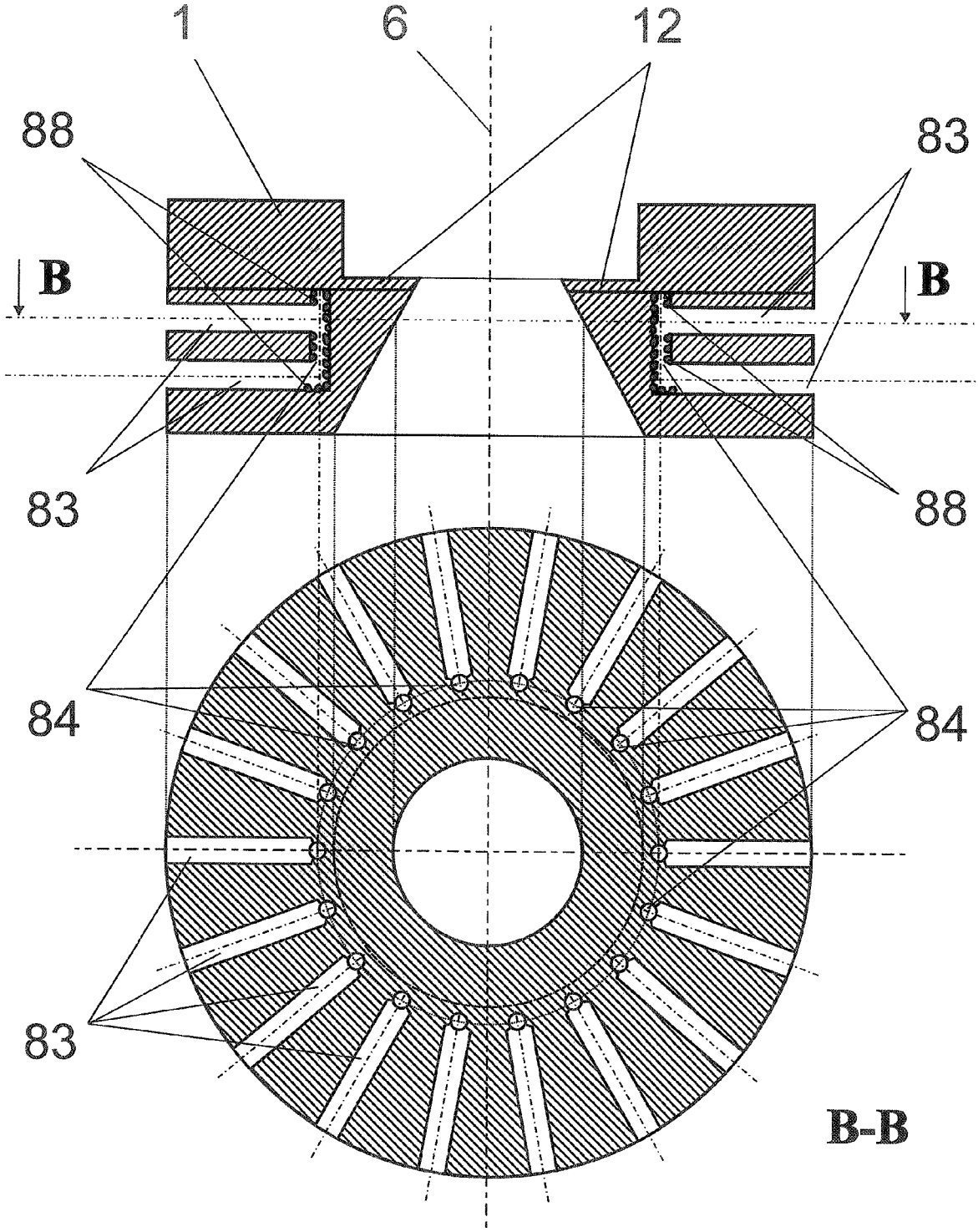
FIG. 6*a* shows a variant for forming the cooling channels and the necked-down channel portions with a ring comprising a plurality of coaxial individual bore holes shown in an axial section of the electrode housing analogous to FIG. 5*a* and an accompanying sectional top view in an orthogonal section plane B-B.
Figure 6B:
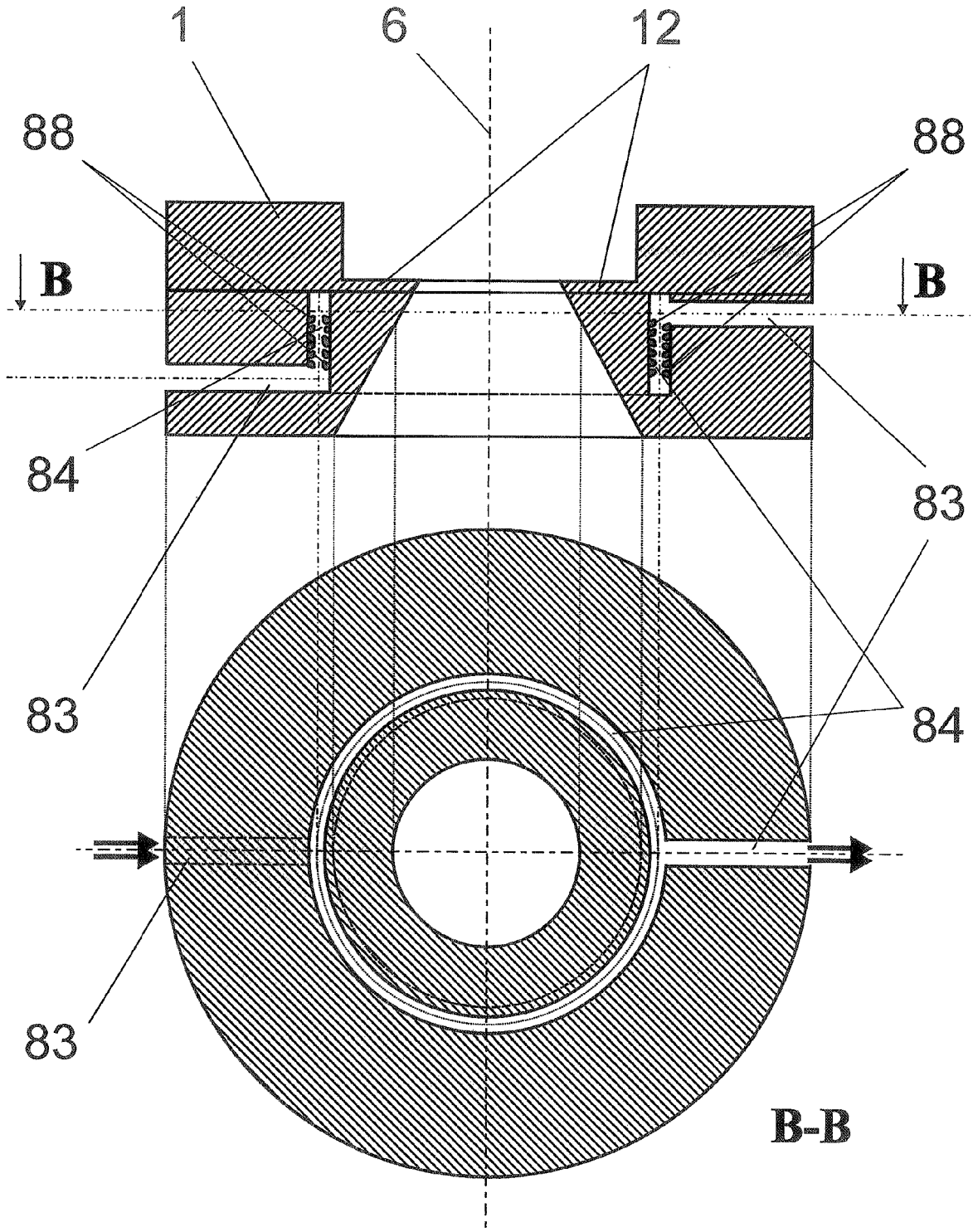
FIG. 6*b* shows another construction of the cooling channels and the necked-down channel portions with a concentric annular gap shown in an axial section of the electrode housing analogous to FIG. 5*a* and an accompanying sectional top view in an orthogonal section plane B-B.

The schematic views of the electrode housing 1 in FIGS. 5*a* and 5*b* and in FIGS. 6*a* and 6*b* in which cooling channels 83 and channel portions 84 are introduced show how the channel structures 85 are introduced. The procedure for the electrode housing 2 is completely analogous.

In order to produce the cooling structures, the electrode housing 1 according to FIG. 5*a* is divided above the electrode collar 12 into two parts (or has already been manufactured in two matching parts) in which the radial cooling channels 83 corresponding to FIG. 6*a* or FIG. 6*b* are first incorporated, and coaxial channel portions 84 with a smaller diameter which are close to the surface are then drilled in from the separation plane A-A of the electrode housing 1. The channel structure 85 is subsequently introduced in the bore hole of the channel portion 84, which bore hole is open on one side. For this purpose, metal particles or metal ceramic particles in the form of granules 88 are applied to the inner walls of the necked-down channel portions 84 by metal coating techniques such as spraying accompanied by surface melting of the granules 88, possibly with subsequent sintering or granule bombardnent on the corresponding surfaces under high pressure, or by suitable solder connection particularly for metal ceramic granules 88). The metal particles or metal ceramic particles are then bonded almost homogeneously (e.g., melted or soldered).

The particle size of the applied granules 88 (or beads, or the like) depends on the material that is used, on the selected application technique, and on the existing cross section of the channel portion 84 in the electrode housings 1 and 2. It can range from several micrometers to several millimeters. For example, copper granules or copper pellets with particle sizes of up to 1 mm or diamond granules with particle sizes of barely more than 0.1 mm can be applied to the inner walls of the channel portions 84 under high pressure.

Heat-conducting parts are preferably made from copper or have proportions of copper, so the granules 88 should likewise comprise copper or copper alloys.

By increasing the effective surface of the channel portions 84 of the cooling channels 83 close to the surface in this way, as is shown in FIG. 3, a faster heat transfer to the circulating coolant is made possible in a simple manner. By coating the inner surfaces of the channel portions 84 with granular material 88, a heat dissipation of up to a few kW/cm$^2$ is achieved, which comes very close to the heat dissipation achieved through the use of porous materials, although at a comparatively lower technical cost.

In other respects, the radiation source in FIG. 3 functions in the same manner as described in FIG. 1. However, a special design feature consists in the insulation between the two electrode housings 1 and 2. In contrast to the insulator disk shown in FIG. 1, a vacuum gap is used as insulator layer 23 in FIG. 3. This vacuum gap is connected to the vacuum pump device 41 of the vacuum unit 4 and ensures a separation of the electrode housings 1 and 2 which resists dielectric breakdown. The advantage consists chiefly in that an increasing conductivity such as is evidenced in ceramic insulators due to the deposition of spattered electrode material does not occur.

In another constructional variant which is shown schematically in FIG. 1, the respective necked-down channel portion 84 in the electrode housings 1 and 2 is structured by suitable surface treatment methods, e.g., by blasting (with blast materials such as chilled cast granules, glass beads, steel shot or corunmdum), etching techniques, or by pulverization methods. This structuring of the channel portions 85 results in an improved heat exchange of up to a few kW/cm$^2$ which gives results that are nearly comparable to the highly developed cooling principles of porous or capillary structures 86 or 87 (FIG. 2) at a lower cost.

Figure 4:
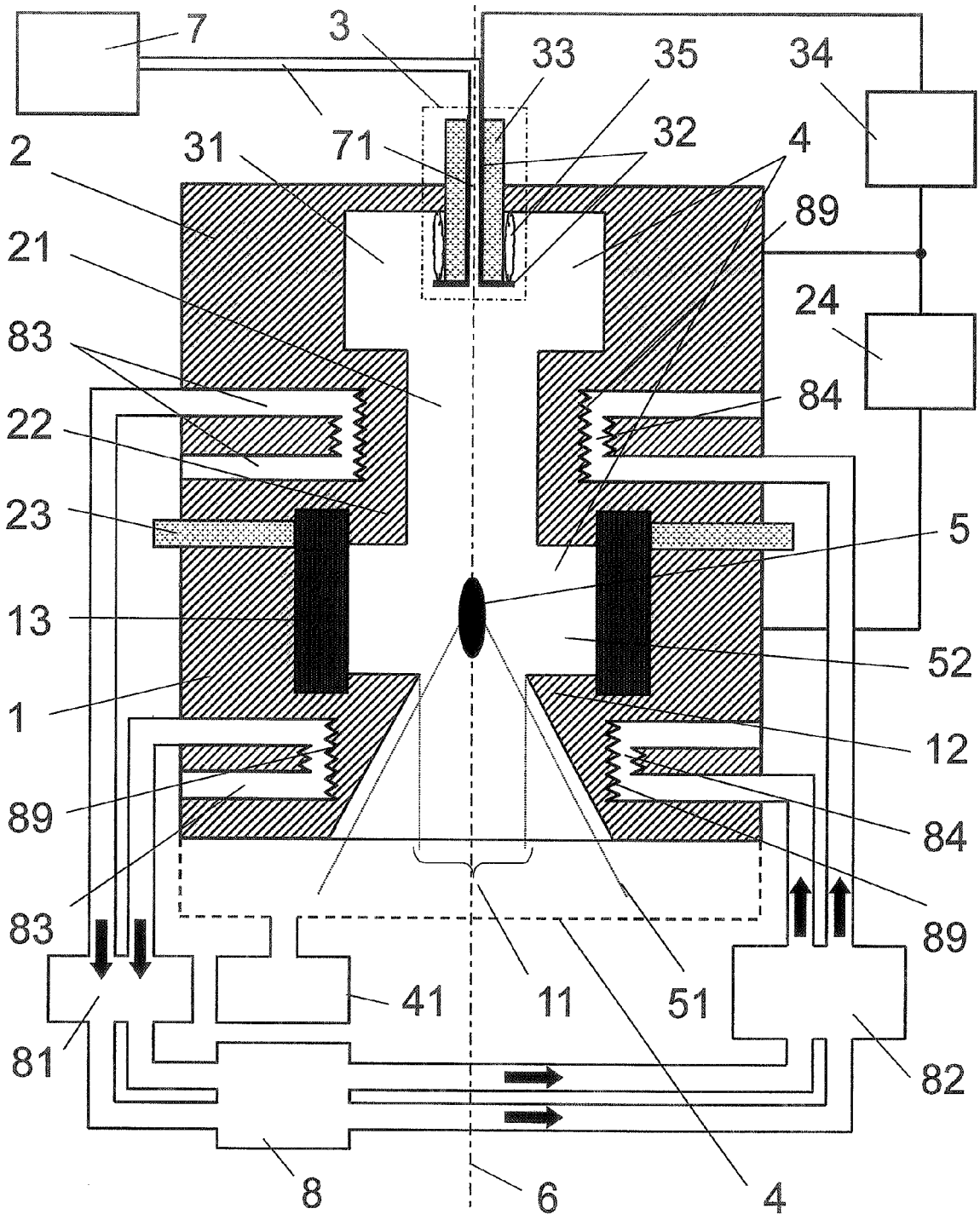
FIG. 4 shows an embodiment form of the invention with cooling channels which were fashioned as bore holes with a thread structure.

In the construction shown in FIG. 4, an improved heat transfer to the circulating coolant is achieved in that an enlargement of the surface of the channel portions 84 of the two electrode housings 1 and 2 is effected by cutting a thread 89 into each necked-down channel portion 84. The effective heat transfer to the circulating coolant is increased and can likewise amount to a few kW/cm$^2$. With a coolant throughput of a few liters to a few tens of liters per minute and a pressure of a few bar to a few tens of bar, the entire cooling circuit comprising a heat exchanger system 8, a coolant reservoir 81, a coolant pump unit 82 and the associated coolant lines must be designed in a corresponding manner with pumps of a few kilowatts power for these operating conditions.

The minimal production costs for an electrode housing 1 or 2 cooled by this channel structure 85 in the form of a thread 89 in the area near the electrode surface or the electrode collars 12 and 22 justify the one-time additional investment in a more efficient cooling circuit. Further, the channel portions 84 can also be coated additionally with granular material 88 (as was described with reference to FIG. 3) in this channel structure 85 in order to further increase the active surface of the channel portions 84 through increased roughness.

Two preferred methods according to the invention for producing necked-down channel portions 84 with channel structures 85 in the first electrode housing 1 are shown in FIG. 5 in partial views FIGS. 5*a* and 5*b*. All steps are carried out in the same way for the second electrode housing 2.

FIG. 5*a* shows that bore holes with a small diameter (between 100 μm and 1 mm) are introduced along a circle in the vicinity of the surface of the electrode collar 12 in an electrode housing 1 in a first step for providing a necked-down, larger-surface channel portion 84 of the cooling channels 83. The distance from the surfaces should be kept as small as possible for an efficient heat removal, but depends to a great degree on the electrode geometry that is used and on the desired lifetime. Typical distances between the surface to be cooled and the channel portions 84 are 5 to 10 mm. A distance of less than 5 mm is generally not useful because there must be sufficient material available for the inevitable electrode erosion so that the cooling circuit does not open after only a brief operating period.

In a second step, a thread 89 is cut into the bore hole as a surface structure. This produces an increase in the inner surface of the necked-down channel portions 84 according to the view in FIG. 4.

In a third step, after introducing the bore holes parallel to the axis and cutting in threads 89 in a uniformly distributed manner and coaxially around the axis of symmetry 6 along the entire electrode collar 12 of the electrode housing 1, larger bore holes are made in radial direction of the electrode housing 1 in such a way that two of these radial bore holes, in each instance, meet the channel portion 83—which has a thread 89 and is produced by the smaller bore hole—in parallel planes in the center and act as an inlet and an outlet (cooling channels 83) for the necked-down channel portion 84. For a channel portion 84, one of these cooling channels 83 is the inlet and one is the outlet for the coolant, and the active necked down channel portion 84 structured by the thread 89 lies therebetween.

In the fourth step, the portions of the threaded bore hole 89 which are located above the vertically highest cooling channel 83 and which are not required are closed by a closure screw 9 for sealing the entire cooling channel 83 and 84 so that the necked-down channel portion 84 only joins the two cooling channels 83 that adjoin in axial section.

FIG. 5*b* shows a second production method for the cooling channels 83 and the necked-down channel portions 84. In a first step, the electrode housing 1 is divided orthogonal to the axis of symmetry 6 into a top part and a bottom part (or is produced in two correspondingly matching parts).

In a second step—in contrast to FIG. 5*a*—the bore holes for the cooling channels 83, which bore holes are directed radial to the axis of symmetry, are first drilled in the bottom part of the electrode housing 1.

After this, in a third step, proceeding from the separation plane A-A, the connection of the two cooling channels 83 is made through a bore hole with a smaller diameter, which is the necked-down channel portion 84. This results in the multi-channel structure shown in horizontal section in FIG. 6*a*.

The channel portions 84 can also be joined in the form of a cylindrical annular gap (shown only in FIG. 6*b*) so that they form a closed gap around the electrode collar 12 coaxially around the axis of symmetry 6. The cylindrical annular gap can be produced by a cutter rotating around the axis of symmetry 6 or by means of a circular saw, in which case the material inside the circular hole remains so that only a narrow kerf (annular gap) is formed. In this case, the third method step of drilling the necked-down channel portions 84 is replaced by a circular cut around the axis of symmetry 6, which can very well be considered as an incomplete circular bore hole in which the drill core remains. In this construction of the necked-down channel portions 84, it is only necessary to drill one cooling channel 83 for the supply of coolant and one cooling channel 83 as an outlet for the connection to the heat exchanger system 8 (as is shown in FIG. 1) in the second production step. The two cooling channels 83 are arranged in different horizontal planes of the electrode collar 12 (or 22) so as to be offset by 180° around the axis of symmetry 6.

Granular material 88 is sprayed in in the fourth production step and is melted together with the inner surfaces of the channel portion 84 in step 5 by corresponding temperature management T (e.g., by sintering, soldering or, in combination with the fourth processing step, by high-pressure application of granules 88). This results in an efficient channel diameter of, preferably, a few 100 μm in the channel portion 84.

The superfluous opening of the channel portion 84 up to the separation surface A-A which results from drilling or cutting out an annular gap around the entire electrode collar 12 is joined and sealed in the sixth step to form the complete electrode housing 1 by placing the top part of the electrode housing 1 and melting together the two surfaces of the separation plane A-A.

An axial section of the electrode housing 1 equivalent to FIG. 5*a* is shown in a top view in FIG. 6*a* and FIG. 6*b* to illustrate the cooling system in an electrode housing 1 according to the invention. This axial section is associated with a sectional top view in section plane B-B.

As can be seen in the sectional view at the bottom in FIG. 6*a*, the necked-down channel portions 84 are introduced so as to be uniformly distributed around the axis of symmetry 6 and are arranged as close together as possible depending on cooling requirements. The shortest distance of the channel portions 84 from the highly thermally stressed surface of the electrode collar 12 is generally between 5 and 10 mm. Substantially decreasing this distance at the highly stressed surfaces would result in a reduced life because the residual layer thickness of the electrode collar 12 would be removed too quickly due to electrode erosion. This would defeat the purpose of efficient electrode cooling, which is to increase lifetime.

According to FIG. 6*a*, the cooling channels 83 having larger dimensions are drilled in two different orthogonal planes with respect to the axis of symmetry 6 up to the necked-down channel portion 84 for each of the vertical channel portions 84 as inlet and outlet channels for the coolant.

The coolant circulation takes place from the periphery of the electrode housing 1 through connection of a supply line from the coolant pump unit 82 (shown only in FIG. 1 to FIG. 4) to one of the cooling channels 83, and the coolant is then pressed at high pressure (generally 2 bar to 20 bar) through the necked-down channel portion 84 whose surface was preferably increased by means of the methods mentioned above.

The heat which develops during the operation of the radiation source, chiefly through resistance heating and through radiation heating of the regions of the electrode housing which are directly exposed to the generated radiation, is absorbed by the coolant in the necked-down channel portions 84 which flows in through the cooling channels 83 and passes over a corresponding outlet of the cooling channels 83 and via lines in the cooling circuit to the heat exchanger system 8, where the heat is dissipated. The coolant is pumped to the corresponding inlet of the cooling channels 83 via the coolant pump unit 82 and is then pressed through the necked-down channel portions 84 of the electrode housing 1 again at high pressure and high speed.

The multi-channel structure of cooling channels 83 and necked-down channel portions 84 shown in FIG. 6*a* represents only one possibility. A design of the cooling structure for an electrode collar 12 (or 22) that is simpler with respect to production technique is shown in FIG. 6*b*.

The necked-down channel portions 84 are combined in this case to form a cylindrical annular gap which surrounds the electrode collar 12 concentric to the axis of symmetry 6. This shape of the completely encircling channel portion 84 can either be routed by rotating a cutter around the axis of symmetry 6 or cut in by a circular saw, in which case the circular cutout (the electrode collar 12) remains because the circular cut terminates at the bottom orthogonal plane (parallel to the orthogonal section plane B-B) of the cooling channels 83.

The cooling channels 83 can be arranged in such a way that there is always only one inlet and one outlet for the coolant. Therefore, the two connections (inlet, outlet) are arranged in FIG. 6*b* so as to be offset by 180° in different orthogonal planes. At sufficiently high pressure, the coolant flows from the cooling channel 83 serving as inlet via the annular gap in both directions around the respective half circumference as well as vertically in direction of the upper orthogonal plane in which the cooling channel 83 functioning as outlet is located opposite the coolant inlet. Since the coolant is pressed through the bottleneck under high pressure at all points along the circumference, relatively high flow rates of 10 l/min or more are possible in channel bottlenecks 84 of a few hundred micrometers.

While the foregoing description and drawings represent the present invention, it will be be obvious to those skilled in the art that various changes may be made therein without departing from the true spirit and scope of the present invention.

REFERENCE NUMBERS

1 first electrode housing
11 outlet opening
12 electrode collar
13 tubular insulator
2 second electrode housing
21 necked-down outlet
22 electrode collar
23 electrically insulating layer
24 high-voltage pulse generator

3 preionization unit
31 preionization chamber
32 preionization electrode
33 insulator tube
34 preionization pulse generator
35 sliding discharge
4 vacuum chamber
41 vacuum pump device
5 plasma
51 emitted radiation
52 discharge chamber
6 axis of symmetry
7 gas supply unit
8 heat exchanger system
81 coolant reservoir
82 coolant pump unit
83 cooling channel (radial)
84 (necked-down) channel portion
85 channel structure
86 porous material
87 capillary structure
88 granules
89 thread
9 closure (screw)
A-A section plane
B-B orthogonal section plane

What is claimed is:

1. An arrangement for the generation of short-wavelength radiation based on a hot plasma generated through gas discharge comprising:

a discharge chamber which is enclosed by and evacuated in a first and a second coaxial electrode housing and in which a work gas is introduced under a defined pressure and which has an outlet opening for the short-wavelength radiation;

said two electrode housings being electrically insulated from one another so as to resist dielectric breakdown by an insulator layer;

said second electrode housing projecting by a necked-down outlet into the first electrode housing to enable a gas discharge with a region around the outlet opening of the first electrode housing;

said first electrode housing around the outlet opening and the second electrode housing at the necked-down outlet each have an electrode collar so that the gas discharge for generating the radiating plasma is deliberately ignited between these electrode collars inside the discharge chamber of the first electrode housing;

special cooling channels for circulating coolant being integrated in the electrode material in the electrode collars;

said cooling channels being advanced radially up to within a few millimeters of the highly thermally stressed surface regions of the electrode collars and have a necked-down channel portion in the area of the highly stressed surface substantially parallel to the axis of symmetry of the electrode housings in order to increase the flow rate of a circulating coolant; and said necked-down channel portion being provided with channel structures for increasing the inner surface and for further increasing the flow rate of the circulating coolant, said channel structures being generated by suitable surface working of the necked-down channel portions.

2. The arrangement according to claim 1, wherein the necked-down channel portion is structured by subsequent removal of material.

3. The arrangement according to claim 2, wherein the removal of material is carried out by abrasive blasting with one of the following blast materials: chilled cast granules, glass beads, steel shot, or corundum.

4. The arrangement according to claim 2, wherein the necked-down channel portion is structured by removing material by means of etching.

5. The arrangement according to claim 2, wherein the necked-down channel portion is structured by removing material by means of material pulverization.

6. The arrangement according to claim 1, wherein the necked-down channel portion is structured by subsequent coating.

7. The arrangement according to claim 6, wherein the necked-down channel portion is structured by applying granular material.

8. The arrangement according to claim 7, wherein the granular material comprises at least one metal, metal alloy or metal ceramic with very good thermal conductivity.

9. The arrangement according to claim 8, wherein the granular material comprises at least one of the metals copper, aluminum, silver, gold, molybdenum, tungsten or an alloy thereof.

10. The arrangement according to claim 8, wherein the granular material comprises one of the alloys MoCu, WCu or AgCu.

11. The arrangement according to claim 8, wherein the granular material comprises one of the metal ceramics AlO, SiC or AlN.

12. The arrangement according to claim 8, wherein the granular material comprises diamond.

13. The arrangement according to claim 8, wherein the diameter of the necked-down channel portion is adapted to the particle size of the granular material that is used, wherein the diameter of the channel portion is at least twice as large as the particle size of the granules.

14. The arrangement according to claim 13, wherein the diameter of the necked-down channel portion is between 100 μm and 2 mm.

15. The arrangement according to claim 1, wherein the necked-down channel portion is constructed as a coaxial annular gap around the axis of symmetry.

16. The arrangement according to claim 1, wherein the necked-down channel portion is constructed as a bore hole.

17. The arrangement according to claim 16, wherein the necked-down channel portion constructed as a bore hole is structured by cutting in a thread.

18. The arrangement according to claim 1, wherein a low-viscosity coolant flows through the necked-down channel portions.

19. The arrangement according to claim 18, wherein deionized water is used as low-viscosity coolant.

20. The arrangement according to claim 18, wherein a special low-viscosity oil is used as coolant.

21. The arrangement of claim 20, wherein said special low-viscosity oil is galden.

22. A method for producing coolant-carrying electrode housings for hot plasma generated by gas discharge, wherein a discharge chamber is enclosed by and evacuated in a first and a second coaxial electrode housing and a work gas is introduced into the latter under a defined pressure, wherein the two electrode housings are electrically insulated from one another so as to resist dielectric breakdown by an insulator layer and have cooling channels, and the second electrode housing projects by a necked-down outlet into the first electrode housing to enable a gas discharge with an oppositely located region of the first electrode housing, comprising the steps of:

drilling the cooling channels into the electrode housings in at least two different orthogonal planes relative to an axis of symmetry of the electrode housings radially inward proceeding from the outside to a distance of up to a few millimeters from the highly thermally stressed surfaces; and carrying out a necked-down channel portion substantially parallel to the axis of symmetry in such a way that it produces a connection channel of small diameter respectively between two cooling channels of different orthogonal planes in an end region of the radial cooling channels.

23. The method according to claim 22, wherein the necked-down channel portion is recessed concentric to the axis of symmetry as an annular gap so that it surrounds the electrode collar contiguously and completely in an electrode housing, wherein two cooling channels are arranged opposite one another with respect to the axis of symmetry in the different orthogonal planes as inlet and as outlet for the circulating coolant.

24. The method according to claim 22, wherein the necked-down channel portion is drilled coaxial to the axis of symmetry as a bore hole, wherein multiple channel portions of this kind which are drilled in a uniformly distributed manner can be arranged so as to surround the electrode collars inside the electrode housing along a cylindrical outer surface concentric to the axis of symmetry.

25. The method according to claim 22, wherein the necked-down channel portions are provided with a channel structure by material removal in order to increase the inner surface.

26. The method according to claim 25, wherein the channel structure (85) is generated by cutting a thread.

27. The method according to claim 25, wherein the channel structure is generated by etching.

28. The method according to claim 25, wherein the channel structure is generated by material pulverization.

29. The method according to claim 22, wherein the necked-down channel portions are provided with a channel structure by material application.

30. The method according to claim 29, wherein the channel structure is generated by coating with granular material of metal, metal alloy or metal ceramic with good thermal conductivity.

31. The method according to claim 29, wherein the granular material is applied by spraying techniques to the inner surfaces of the necked-down channel portion.

32. The method according to claim 29, wherein the granular material is fixed to the inner surfaces of the channel portion by subsequent sintering.

33. The method according to claim 29, wherein the granular material is fixed to the inner surfaces of the channel portion by a solder connection.

34. The method according to claim 22, wherein openings which are formed at the electrode housings when producing the necked-down channel portions but which are not required for the circulation of coolant are hermetically sealed by closing plugs of electrode material.

35. The method according to claim 34, wherein the closing plug is melted in the opening.

36. The method according to claim 34, wherein the closing plug is screwed in and melted.

37. The method according to claim 22, wherein openings which are formed at the electrode housings when producing the necked-down channel portions but which are not required for coolant circulation are hermetically sealed by covering them with at least one part which is or becomes an integral component part of the electrode housing.

38. The method according to claim 37, wherein the covering part of the electrode housing is produced by cutting the electrode housing along a suitable cutting plane, wherein the cutting is carried out before introducing channel portions.

39. The method according to claim 37, wherein the covering part of the electrode housing is produced by suitable shaping of matching separate parts of the main part and the covering part of the electrode housing, wherein the separate parts of the electrode housing are joined after introducing channel portions in the main part along an imaginary cutting plane.

* * * * *